US005585713A

United States Patent [19]

Crane et al.

[11] Patent Number: 5,585,713

[45] Date of Patent: Dec. 17, 1996

[54] LIGHT DIMMER CIRCUIT WITH CONTROL PULSE STRETCHING

[75] Inventors: Burke J. Crane, Medford, Wis.; Augusto P. Panella, Bolingbrook, Ill.

[73] Assignee: Molex Incorporated, Lisle, Ill.

[21] Appl. No.: 365,867

[22] Filed: Dec. 29, 1994

[51] Int. Cl.[6] ..... G05F 1/455

[52] U.S. Cl. ..... 323/323; 323/319; 323/237; 323/235

[58] Field of Search ..... 323/235, 237, 323/239, 244, 319, 320, 323, 324, 325

[56] References Cited

U.S. PATENT DOCUMENTS

| | | | |
|---|---|---|---|
| 3,671,849 | 6/1972 | Kingston | 323/319 |
| 3,909,703 | 9/1975 | Braddock | 323/322 |
| 3,990,000 | 11/1976 | Digneffe | 323/322 |
| 4,087,702 | 5/1978 | Kirby et al. | 307/252 B |
| 4,274,045 | 6/1981 | Goldstein | 323/319 |
| 4,287,468 | 9/1981 | Sherman | 323/322 |
| 4,317,975 | 3/1982 | Mizukawa et al. | 323/235 |
| 4,745,351 | 5/1988 | Rowen et al. | 323/239 |
| 4,749,917 | 6/1988 | Angott et al. | 315/307 |
| 4,928,055 | 5/1990 | Kaieda et al. | 323/319 |
| 4,935,691 | 6/1990 | Lamar | 323/323 |
| 5,283,516 | 2/1994 | Lohoff | 323/322 |
| 5,336,979 | 8/1994 | Watson et al. | 315/362 |

*Primary Examiner*—Jeffrey L. Sterrett
*Attorney, Agent, or Firm*—Stephen Z. Weiss

[57] ABSTRACT

A dimmer circuit uses a triac for controlling application of power to a hot terminal where a load will be connected. A DC power supply develops DC power for powering a control circuit which includes a zero crossing detector circuit connected to an integrated circuit chip which develops a timer pulse at the appropriate time to dim the light. The timer pulse is output to a pulse stretching circuit which actually drives the triac. The pulse stretching circuit stretches the pulse to a maximum of one-half of a cycle. This ensures that the triac will be turned on even if the inductive current delays the establishment of adequate latching current. This creates a more symmetrical waveform and results in a reduced DC offset.

15 Claims, 2 Drawing Sheets

LIGHT DIMMER CIRCUIT WITH CONTROL PULSE STRETCHING

FIELD OF THE INVENTION

The present invention relates to a circuit for varying AC power applied to a load and, more particularly, to a dimmer circuit for incandescent lights.

BACKGROUND OF THE INVENTION

A typical AC load, such as an incandescent light, is powered by a standard 120 volt AC supply. In one common form of a dimmer circuit, the AC supply is "chopped" each half cycle so that power is actually applied to the load for only a portion of each half cycle. A triac is often used for switching of power to the load. A zero crossing of the AC supply is sensed to trigger a delay circuit. The delay circuit outputs a pulse a select time after the zero crossing according to the amount of dimming required. The pulse gates the triac. The triac turns itself off at the subsequent zero crossing.

When a stepped voltage is applied across an inductive load, the impedance is infinitely high and decreases as the magnetic field is established. With extremely small values of current through an inductor, until the magnetic field is established, the triac does not have enough current to latch on. This is a problem in typical light dimming circuits which use a short turn-on pulse. As a result, due to inductive current delaying the establishment of adequate latching current, the triac will not be turned on.

The present invention is directed to solving the problems discussed above in a novel and simple manner.

SUMMARY OF THE INVENTION

In accordance with the invention there is disclosed a dimmer circuit provided with a pulse stretching circuit.

Broadly, there is disclosed a dimmer circuit for varying AC power applied to a load from a supply. The dimmer circuit includes a bidirectional output switch connected in series between the supply and the load. The output switch comprises a pair of electronic switches connected back to back, the output switch conducting electricity in response to a trigger signal and turning itself off in response to power decreasing below a select holding level. Input means generate commands to selectively increase or decrease power applied to the load. A timer circuit is connected to the supply and the input means for developing a timer pulse signal including a relatively short duration timer pulse generated a select time after each zero crossing of AC input power. The select time is varied by commands from the input means. The timer pulse represents a desired triggering time of the output switch. A pulse stretching circuit is connected to the timer circuit and the output switch for controlling triggering of the output switch. The pulse stretching circuit includes means responsive to the timer pulse for developing a longer duration stretch pulse applied to trigger the output switch. The longer duration is sufficient to latch on the output switch as a result of the inductive load.

It is a feature of the invention that the electronic switches comprise thyristors.

It is another feature of the invention that the electronic switches comprise SCR's.

It is a further feature of the invention that the output switch comprises a triac.

It is another feature of the invention that the longer duration is a maximum of one half of a power cycle.

It is still a further feature of the invention that the pulse stretching means includes a pulse stretching circuit which initiates the stretch pulse concurrent with receiving the timer pulse and terminates the stretch pulse concurrent with a subsequent zero crossing of supplied AC power.

It is yet another feature of the invention that the pulse stretching circuit includes a thyristor gated in response to receipt of the timer pulse and a holding circuit connected to the thyristor for maintaining conduction in the thyristor until a time concurrent with a subsequent zero crossing of supplied AC power.

It is still a further feature of the invention that the holding circuit comprises a bridge rectifier connected to the supply and the ripple of the bridge circuit is voltage limited by a zener diode. The bridge rectifiers connected to the thyristor drop the holding current to zero incident with the zero crossing of the AC voltage.

It is yet another feature of the invention that the thyristor comprises an SCR.

It is still another feature of the invention to provide an opto-isolator connected between the pulse stretching circuit and the output switch.

More particularly, the dimmer circuit uses a triac for controlling application of power to a hot terminal where a load will be connected. A DC power supply develops DC power for powering a control circuit which includes a zero crossing detector circuit connected to an integrated circuit chip which develops the timer pulse at the appropriate time to dim the light. The timer pulse is output to a pulse stretching circuit which actually drives the triac. The pulse stretching circuit stretches the pulse to a maximum of one-half of a cycle. This ensures that the triac will turn on even if the inductive current delays the establishment of adequate latching current. This creates a more symmetrical waveform and results in a DC offset of less than one percent.

Further features and advantages of the invention will be readily apparent from the specification and from the drawing.

DETAILED DESCRIPTION OF THE INVENTION

Figure 1:
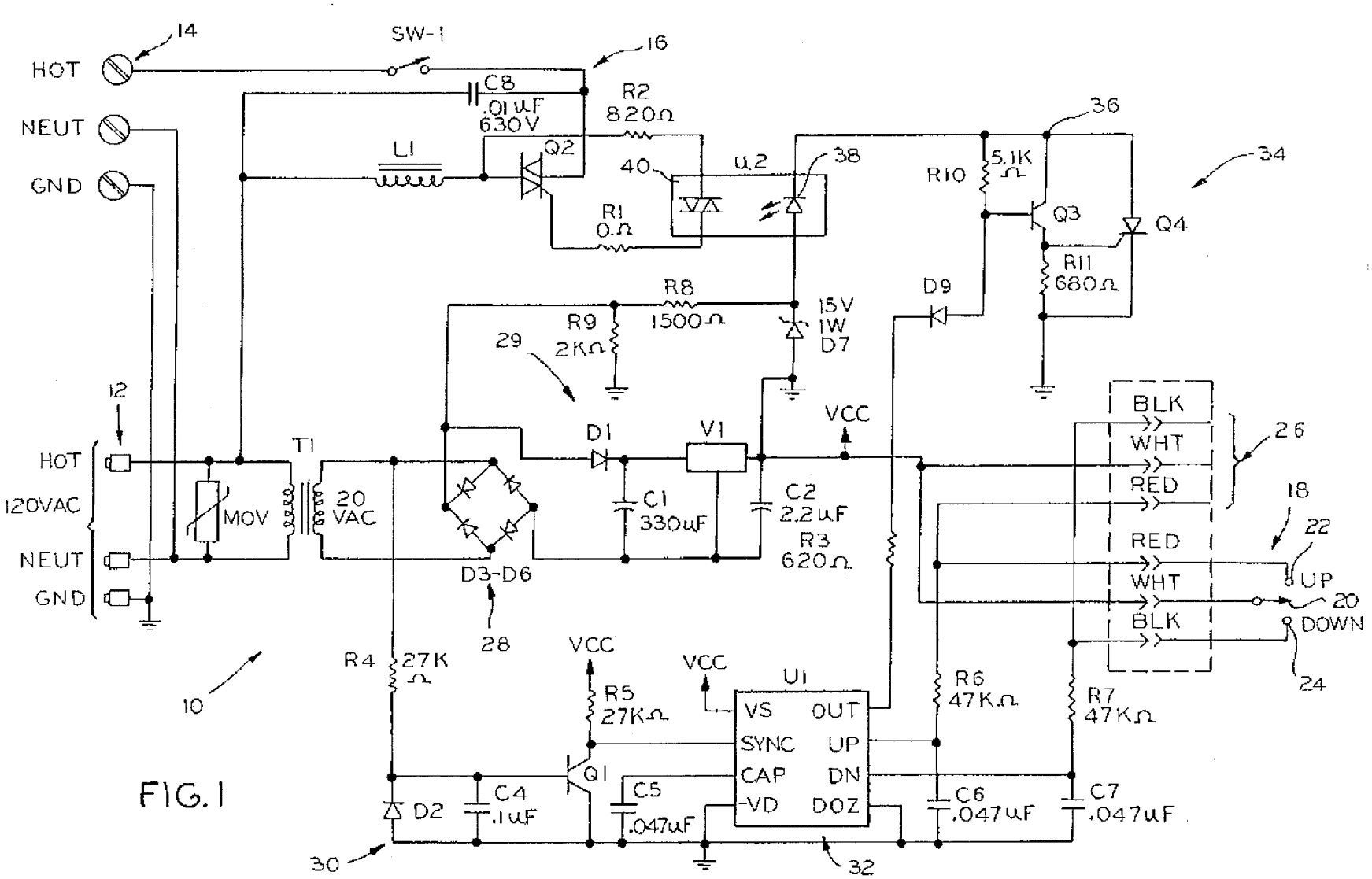
FIG. 1 is a schematic diagram of a light dimmer circuit according to the invention.

Referring to FIG. 1, a dimmer circuit 10 varies AC power applied to a load from a supply. The dimmer circuit 10 includes supply terminals 12 for connection to a 120 volt AC supply. The dimmer circuit 10 varies the AC power from the supply for delivery to output terminals 14 for connection to a load. While not specifically limited therefor, the dimmer circuit 10 is particularly adapted for connecting to inductive loads, such as incandescent lights or transformers.

Supply terminals 12 are provided for neutral and ground and are directly connected to corresponding neutral and ground output terminals 14. A hot input terminal 12 is connected through an output circuit 16 to a hot output terminal 14. Particularly, the output circuit 16 includes an inductor L1 connected in series with an output switch Q2 and an air gap switch SW-1 to the hot output terminal 14. A capacitor C8 is connected across the series combination of the inductor L1 and output switch Q2. The inductor L1 and capacitor C8 operate as a filter to knock the rise time off a turn-on pulse and to reduce radiated emissions. The air gap switch SW-1 satisfies UL requirements for dimmers by providing a break in the hot line for safety purposes.

The output switch Q2 is comprised of electronic switches, such as a triac or a pair of SCR's connected back-to-back. In the illustrated embodiment of the invention, the output switch Q2 comprises a triac. As is well known, a triac latches on to conduct for either polarity of load voltage in its circuit. The triac Q2 latches on in response to a trigger signal at its gate. Once latched on by the gate signal, load current is independent of gate voltage or current. Instead, the triac remains latched on, conducting and holding current, until the main circuit reduces forward voltage below a value required to sustain conduction. Then when the triac is off, a gate signal can turn it on again.

An input circuit 18 comprises a movable contact 20 selectively connected to either an up terminal 22 or down terminal 24 for generating commands to respectively increase or decrease power applied to the load via the output terminals 14. Although not shown, the circuit 10 is illustrated for use as a wall-type switch, with the input switch 18 including a toggle switch or the like with carbon fingers to close the contacts. Particularly, the movable contact 20 is connected to either the up terminal 22 or the down terminal 24 as long as the user depresses the toggle switch or the like. Upon release of the toggle switch the contacts are open. The air gap switch SW1 comprises a maintained-type contact switch. Alternatively, a second input 26, in parallel with the input circuit 18, can be used for connecting to a remote circuit for generating commands to selectively increase or decrease power applied to the load.

The supply terminals 12 are connected to a step down transformer T1 which develops 20 volt AC power in a secondary winding. The secondary of the transformer T1 is connected to a bridge rectifier 28 including diodes D3, D4, D5 and D6. The rectified power is supplied to a DC power supply 29 including a diode D1 and a voltage regulator circuit V1 which develops regulated power VCC for powering various circuit components.

The high side of the secondary of the transformer T1 is connected to a zero crossing detector circuit 30 including a resistor R4, diode D2 and capacitor C4 connected to the base of a transistor Q1. The transistor Q1 in turn is connected to a timer circuit 32. Particularly, the transistor Q1 is connected to the sync input of an integrated circuit U1. The integrated circuit U1 comprises an LSI LS7535 continuous dimmer light switch circuit with separate up/down controls. Particularly, the circuit U1 is designed for use as a dimmer of incandescent lamps. An output at a terminal labeled OUT controls brightness of a lamp by controlling firing angle of a triac connected in series with the load. The output occurs once every half cycle of line frequency. Within the half cycle, the output can be positioned anywhere between 159° phase angle for maximum brightness and 41° phase angle for minimum brightness in relation to line frequency. The positioning of the output is controlled by applying the proper logic levels at the UP and DOWN inputs connected to the input circuits 18 and 26, as shown.

In a typical application, the OUT terminal develops a negative going pulse applied directly to the gate of a triac. However, with inductive loads problems can exist due to inductive current delaying establishment of an adequate latching current. In accordance with the invention, this problem is minimized with a pulse stretching circuit 34 connected between the output of the timer circuit 32 and the triac Q2.

The pulse stretching circuit 34 includes a diode D9 connected through a resistor R3 to the OUT terminal of the integrated circuit U1. The opposite side of the diode D9 is connected to the base of a PNP transistor Q3. The emitter of the transistor Q3 is connected to a junction 36. A resistor R10 is connected between the junction 36 and the base of the transistor Q3. The collector of the transistor Q3 is connected via a resistor R11 to ground and to the gate of a thyristor Q4 in the form of an SCR. The cathode of the SCR Q4 is connected to ground. The anode of the SCR Q4 is connected to the junction 36.

The pulse stretching circuit 34 is connected to the triac Q2 via an opto-isolator U2 including an LED 38 and opto-triac 40. The opto-triac 40 is connected from one terminal of the triac Q2 via a resistor R2 and through a zero ohm resistor R1 to the gate of the triac Q2. The LED 38 is connected between the pulse stretching circuit junction 36 and a zener diode D7 to ground. The junction between the LED 38 and the zener diode 27 is connected via resistors R8 and R9 to the bridge rectifier circuit 28.

Figure 2:
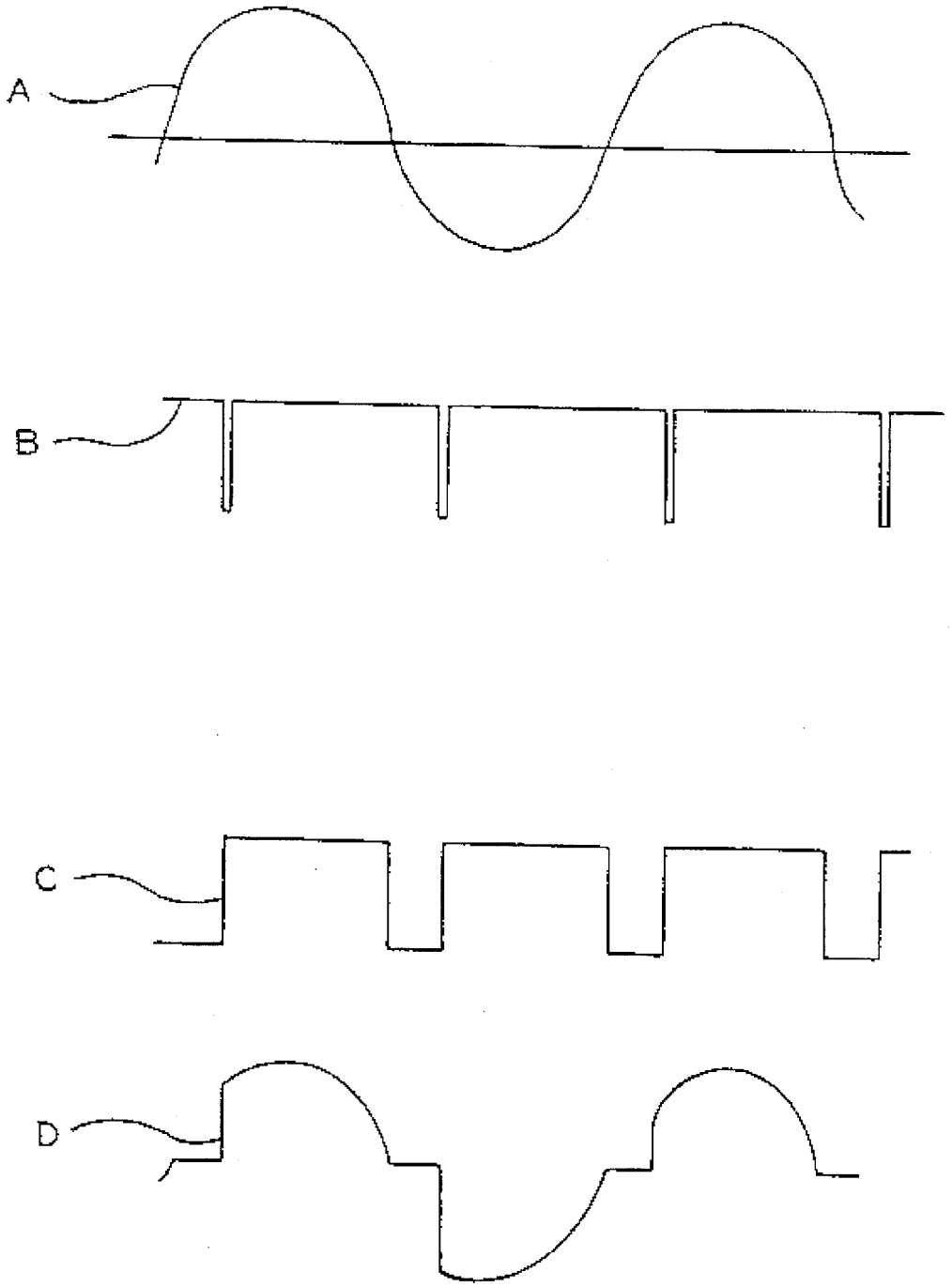
FIG. 2 is a series of waveforms illustrating operation of the light dimmer circuit of FIG. 1.

Referring also to FIG. 2, a series of waveforms illustrate operation of the dimmer circuit 10. A curve A represents sinusoidal AC power received at the supply terminals 12 from the AC supply. Each zero crossing of the AC power is detected by the zero crossing detector 30 and applied via the transistor Q1 to the sync input of the IC U1 of the timer circuit 32. The IC U1 develops a timer pulse signal, labeled B in FIG. 2, including a relatively short duration low going timer pulse generated a select time after each zero crossing of AC input power. The select time is varied by commands from the input circuit 18 or the input circuit 26. Each pulse of the waveform B turns the transistor Q3 off, causing the SCR Q4 to be gated on. As is characteristic with SCR's, the SCR Q4 maintains conduction until the forward voltage is reduced below a value required to sustain conduction. The source voltage is used as the supply for the SCR Q4 to maintain it "on". The "on" time of the SCR Q4 is represented by a pulse waveform labeled C, see FIG. 2. This pulse signal is applied through the opto-isolator U2 to the gate of the triac Q2. Particularly, the bridge rectifier 28 is voltage limited by the zener diode D7. The bridge rectifier 28 drops the holding current to zero to terminate the pulse of the waveform C as by turning the SCR Q4 off concurrent with a subsequent zero crossing of supplied AC voltage. Thus, the pulse stretching circuit 34 controls "on" time and "off" time of the pulse waveform C, representing a stretched pulse signal. With the stretched pulse signal each pulse starts concurrent with receiving the timer pulse from the circuit U1 and terminates concurrent with a subsequent zero crossing of supplied AC power. This stretched pulse signal C represents the gating signal supplied to the triac Q2.

The waveform D of FIG. 2 represents the clipped AC signal supplied via the output terminals 14 to the load. As is apparent, the waveform D is generally similar to the waveform A, except being clipped by the triac Q2 being turned on by the initiation of the stretched pulse C and turned off at a subsequent zero crossing of the supply.

Thus, in accordance with the invention, the pulse stretching circuit 34 develops a longer duration stretch pulse to trigger the triac Q2. The longer duration is sufficient to ensure turn-on of the triac Q2 even if the inductive current delays the establishment of adequate latching current. This creates a more symmetrical waveform and results in a reduced DC offset.

The disclosed circuit is intended to broadly illustrate the inventive concepts of the invention.

We claim:

1. A dimmer circuit for varying AC power applied to a load from a supply, comprising:

a bidirectional output switch connected in series between the supply and the load, the output switch latching on to conduct electricity in response to a trigger signal and turning itself off in response to power decreasing below a select holding level;

input means for generating commands to selectively increase or decrease power applied to the load;

a timer circuit connected to the supply and the input means for developing a timer pulse signal including a relatively short duration timer pulse generated a select time after each zero crossing of AC input power, the select time being varied by commands from the input means, the timer pulse representing a desired triggering time of the output switch; and a pulse stretching circuit connected to said timer circuit and said output switch for controlling triggering of the output switch, the pulse stretching circuit including pulse stretching means responsive to the timer pulse for developing a longer duration stretched pulse applied to trigger the output switch, the longer duration being sufficient to latch on even if inductive current delays establishment of adequate latching current.

2. The dimmer circuit of claim 1 further comprising an opto-isolator connected between said pulse stretching circuit and said output switch.

3. The dimmer circuit of claim 1 wherein said output switch comprises a triac.

4. The dimmer circuit of claim 1 wherein said longer duration is a maximum of one half of a power cycle.

5. The dimmer circuit of claim 1 wherein said pulse stretching means initiates the stretched pulse concurrent with receiving the timer pulse and terminates the stretched pulse concurrent with a subsequent zero crossing of supplied AC power.

6. The dimmer circuit of claim 5 wherein said pulse stretching circuit includes a thyristor gated in response to receipt of said timer pulse and a holding circuit connected to said thyristor for maintaining conduction in said thyristor until a time concurrent with a subsequent zero crossing of supplied AC power.

7. The dimmer circuit of claim 6 wherein said holding circuit comprises a bridge rectifier connected to said supply and ripple of said bridge rectifier circuit is voltage limited by a zener diode, the bridge rectifier circuit being connected to said thyristor to drop holding current to zero incident with a subsequent zero crossing of supplied AC power.

8. The dimmer circuit of claim 5 wherein said thyristor comprises an SCR.

9. A light dimmer circuit for varying AC power applied to a load from a supply, comprising:

a triac connected in series between the supply and the load, the triac conducting electricity in response to a trigger signal and turning itself off in response to power decreasing below a select holding level;

input means for generating commands to selectively increase or decrease power applied to the load;

a timer circuit connected to the supply and the input means for developing a timer pulse signal including a relatively short duration timer pulse generated a select time after each zero crossing of AC input power, the select time being varied by commands from the input means, the timer pulse representing a desired triggering time of the triac; and a pulse stretching circuit connected to said timer circuit and said triac for controlling triggering of the triac, the pulse stretching circuit including pulse stretching means responsive to the timer pulse for developing a longer duration stretched pulse applied to trigger the triac, the longer duration being sufficient to latch on the output switch even if inductive current delays establishment of adequate latching current.

10. The dimmer circuit of claim 9 further comprising an opto-isolator connected between said pulse stretching circuit and said triac.

11. The dimmer circuit of claim 10 wherein said longer duration is a maximum of one half of a power cycle.

12. The dimmer circuit of claim 10 wherein said pulse stretching means includes a pulse stretching circuit which initiates the stretched pulse concurrent with receiving the timer pulse and terminates the stretched pulse concurrent with a subsequent zero crossing of supplied AC power.

13. The dimmer circuit of claim 12 wherein said pulse stretching circuit includes a thyristor gated in response to receipt of said timer pulse and a holding circuit connected to said thyristor for maintaining conduction in said thyristor until a time concurrent with a subsequent zero crossing of supplied AC power.

14. The dimmer circuit of claim 13 wherein said holding circuit comprises a bridge rectifier connected to said supply and ripple of said bridge rectifier is voltage limited by a zener diode, the bridge rectifier circuit being connected to said thyristor to drop holding current to zero incident with a subsequent zero crossing of supplied AC power.

15. The dimmer circuit of claim 13 wherein said thyristor comprises an SCR.

* * * * *